US008269586B2

(12) United States Patent
Matsui et al.

(10) Patent No.: US 8,269,586 B2
(45) Date of Patent: Sep. 18, 2012

(54) LARGE-CAPACITY VACUUM CIRCUIT BREAKER

(75) Inventors: Yoshihiko Matsui, Numazu (JP); Mitsuyasu Shiozaki, Susono (JP)

(73) Assignee: Japan AE Power Systems Corporation, Tokyo (JP)

( * ) Notice: Subject to any disclaimer, the term of this patent is extended or adjusted under 35 U.S.C. 154(b) by 186 days.

(21) Appl. No.: 12/408,776

(22) Filed: Mar. 23, 2009

(65) Prior Publication Data

US 2009/0250436 A1 Oct. 8, 2009

(30) Foreign Application Priority Data

Apr. 2, 2008 (JP) ..... 2008-095665

(51) Int. Cl.
*H01H 1/66* (2006.01)
*H01H 51/00* (2006.01)
*H01H 33/66* (2006.01)

(52) U.S. Cl. ..... 335/151; 218/118; 218/129

(58) Field of Classification Search ..... 335/151; 218/118, 129
See application file for complete search history.

(56) References Cited

U.S. PATENT DOCUMENTS 3,372,259 A * 3/1968 Porter ..... 218/129
3,441,800 A * 4/1969 Lee ..... 361/5
3,469,048 A * 9/1969 Streater et al. ..... 218/2
3,764,764 A * 10/1973 Takasuna et al. ..... 218/127
3,970,809 A * 7/1976 Mitchell ..... 218/5
4,618,750 A * 10/1986 Zuckler ..... 218/129
2002/0043514 A1* 4/2002 Kim, II ..... 218/118
2004/0061504 A1* 4/2004 Krafft et al. ..... 324/424
2008/0308532 A1* 12/2008 Tsuchiya et al. ..... 218/118

FOREIGN PATENT DOCUMENTS

EP 1 294 003 A1 3/2003
GB 1258015 A 12/1971
JP 45-35700 11/1970
JP 56-46140 U 4/1981
JP 4-274119 A 9/1992
JP 3840934 B2 8/2006

* cited by examiner

*Primary Examiner* — Bernard Rojas
(74) *Attorney, Agent, or Firm* — Mattingly & Malur, PC

(57) ABSTRACT

A large-capacity vacuum circuit breaker that can increase a current shutdown capacity and enables its rated current to be increased includes at least two vacuum circuit breaker units placed side by side and connected in parallel. The two vacuum circuit breaker units are operated by a single common operating unit to concurrently perform current shutdown operations. Each vacuum circuit breaker unit has a vertical magnetic field generating means for generating a vertical magnetic field when an operation to shut down current is performed. The vertical magnetic field generating means is formed by vertical magnetic field electrodes provided in a vacuum container of each of the vacuum circuit breaker unit units or by an external coil provided on the outer circumference of each vacuum container.

1 Claim, 4 Drawing Sheets

LARGE-CAPACITY VACUUM CIRCUIT BREAKER

TECHNICAL FIELD

The present invention relates to a large-capacity vacuum circuit breaker and, more particularly, to a large-capacity vacuum circuit breaker that uses at least two vacuum circuit breaker units connected in parallel.

BACKGROUND ART

Vacuum circuit breakers can shut down high current while their sizes are kept small, so they are used in electric power transformation facilities and power distribution facilities. It has been also considered that two or more vacuum circuit breaker units are connected in parallel to have a large capacity so that higher current can be shut down with the vacuum circuit breakers.

In a structure in which two or more vacuum circuit breaker units are simply connected in parallel, however, when a single common operating unit is used to operate these vacuum circuit breaker units to shut down current, a shutdown delay is caused among the vacuum circuit breaker units due to a slight difference between their mechanisms or another reason. When this happens, the vacuum circuit breaker unit that caused a delay in opening the electrodes has to shut down the total current, significantly damaging the electrodes and leading to the inability to use the vacuum circuit breaker unit.

A vacuum circuit breaker for addressing the above problem is proposed in JP 04-274119 A (1992) (Patent Document 1). The vacuum circuit breaker in Patent Document 1 is a large-capacity vacuum circuit breaker that is structured so that two vacuum circuit breaker units are connected in parallel; one of these units uses vertical magnetic field electrodes and the other uses flat-plate electrodes, a current limiting device made of, for example, ceramic being connected in series to the vacuum circuit breaker unit that uses the flat-plate electrodes, the current limiting device having a positive temperature coefficient of resistance. Alternatively, the proposed large-capacity vacuum circuit breaker is structured so that a vacuum circuit breaker unit that uses vertical magnetic field electrodes and a spiral-type vacuum circuit breaker unit that generates high vacuum arc voltage are connected in parallel.

SUMMARY OF THE INVENTION

This type of large-capacity vacuum circuit breaker as in Patent Document 1 enables most of the normal rated current to flow in the vacuum circuit breaker unit that uses the flat-plate electrodes. When the common operating unit is operated to shut down the current in case of an accident, the current limiting device and the spiral electrodes work so that the current is forcibly redirected toward the vacuum circuit breaker unit that uses the vertical magnetic field electrodes, which is superior in shutdown performance, to have it shut down the current.

To enable a vacuum circuit breaker to shut down high current, its electrodes must have a large diameter. In a structure in which large-diameter electrodes are used, however, the entire vacuum circuit breaker becomes large and cannot be manufactured for economic reasons. In the structure of a normal vacuum circuit breaker, its electrodes are disposed facing each other in a vacuum container, so the capacity of the rated current flow is limited.

The large-capacity vacuum circuit breaker in Patent Document 1 is advantageous in that the vacuum circuit breaker units connected in parallel can be operated by using a common operating unit and the compactness of the large-capacity vacuum circuit breaker enables economical manufacturing. Since, however, the vacuum circuit breaker unit that uses the vertical magnetic field electrodes, which has a superior shutdown capacity, shuts down the current, the shutdown capacity of the large-capacity vacuum circuit breaker is defined as the capacity of the vacuum circuit breaker unit that uses the vertical magnetic field. Accordingly, even when the vacuum circuit breaker units are connected in parallel, its rated current cannot be increased.

An object of the present invention is to provide a large-capacity vacuum circuit breaker that has an improved current shutdown capacity and enables its rated current to be increased.

A large-capacity vacuum circuit breaker in the present invention has at least two vacuum circuit breaker units that are placed side by side and connected in parallel; the vacuum circuit breaker units are operated by a single common operating unit so as to perform a current shutdown operation; and each of these vacuum circuit breaker units has a vertical magnetic field generating means for generating a vertical magnetic field when an operation to shut down current is performed.

The vertical magnetic field generating means is preferably structured by disposing spiral electrodes, which face each other, in a vacuum container.

Alternatively, the vertical magnetic field generating means is preferably structured by placing an external coil on the external surface of a vacuum container of each vacuum circuit breaker unit, one end of the external coil being connected to a current conductor of the vacuum circuit breaker unit, the other end being connected to a current conductor of another vacuum circuit breaker unit.

According to the structure in the present invention, individual vacuum circuit breaker units, each of which uses branched rated current, employ a vertical magnetic field generated by a vertical magnetic field generating means to appropriately shut down current, significantly increasing the shutdown capacity of the large-capacity vacuum circuit breaker. Since a current flow can be branched into the vacuum circuit breaker units, which have the same structure and are connected in parallel, a large-capacity vacuum circuit breaker having a large rated current can be manufactured in an economical manner.

DESCRIPTION OF THE EMBODIMENTS

Figure 1:
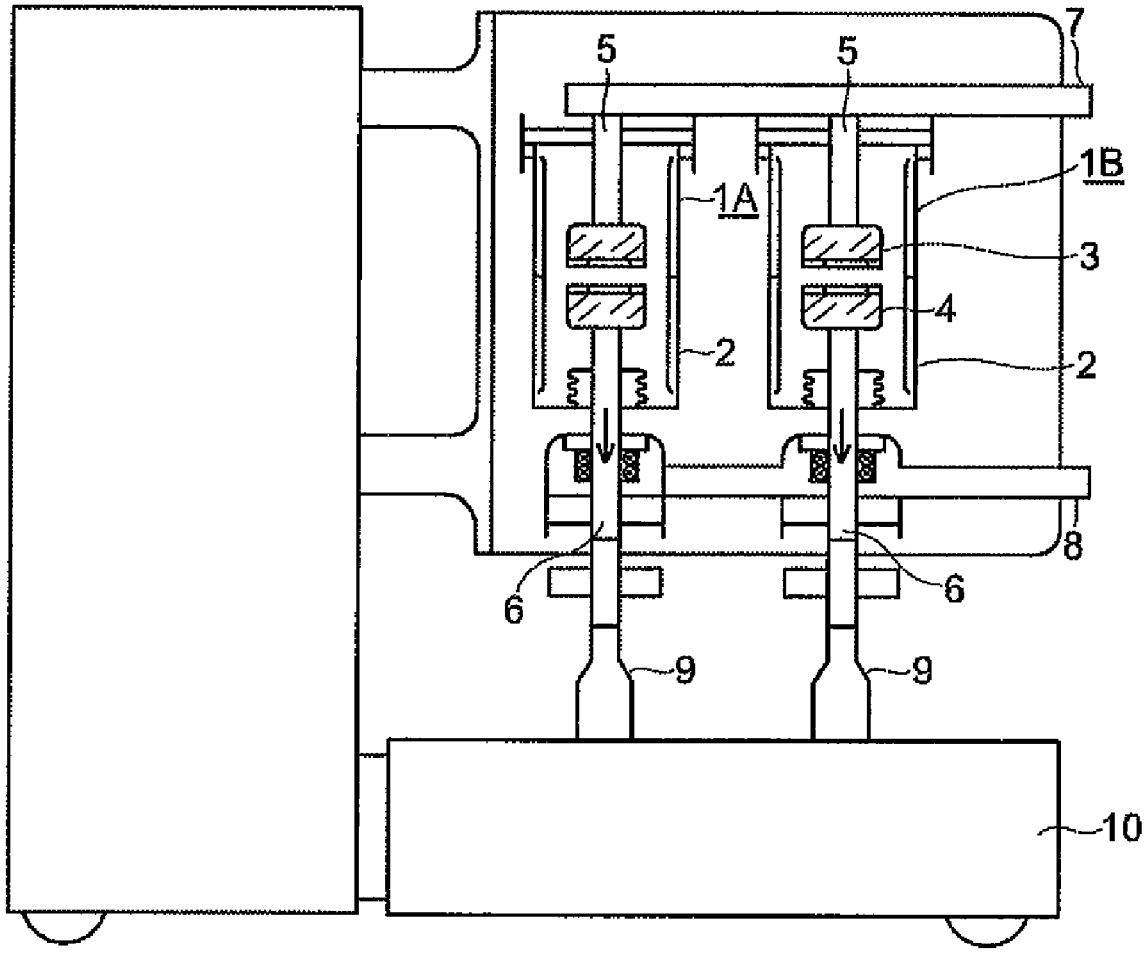
FIG. 1 is a schematic side view of a large-capacity vacuum circuit breaker in a first embodiment of the present invention, part of the side view being a cross sectional view.

A large-capacity vacuum circuit breaker in the present invention has at least two vacuum circuit breaker units placed side by side, which are connected in parallel and perform a shutdown operation when operated by a single common operating unit. Each of these vacuum circuit breaker units connected in parallel has an internal or external vertical magnetic field generating means that generates a vertical magnetic field when an operation for shutting down current is performed.

First Embodiment

A large-capacity vacuum circuit breaker in a first embodiment of the present invention will be described with reference to the drawings showing a structure for a single phase. An exemplary large-capacity vacuum circuit breaker shown in FIG. 1 has two vacuum circuit breaker units, denoted 1A and 1B, which have the same structure and are connected side by side; each vacuum circuit breaker unit has a current conductor 5, which is directly connected to an upper terminal 7, and also has another current conductor 6, which is movable and is connected to a lower terminal 8 through a current collector, so that the two vacuum circuit breaker units are connected in parallel. The current conductor 6 of the vacuum circuit breaker unit 1A is linked through an insulator to an operation axis 9, and the current conductor 6 of the vacuum circuit breaker unit 1B is also liked to another operation axis 9 in the same way; these two current conductors 6 are concurrently operated by a common operating unit 10, so the vacuum circuit breaker units 1A and 1B concurrently perform shutdown operations in the arrow direction indicated in the drawing.

The vacuum circuit breaker units 1A and 1B used in the present invention each have an internal vertical magnetic field generating means, which comprises a vertical magnetic field electrode 3 fixed to the current conductor 5 and a vertical magnetic field electrode 4 fixed to the current conductor 6 in a vacuum container 2, each vertical magnetic field electrode having a known structure and facing the other vertical magnetic field electrode.

Each of the vertical magnetic field electrodes 3 and 4 for generating a vertical magnetic field is formed with a known means such as an elongated cylindrical current conductor having a so-called cup-like shape and a contact piece connected to an end of the cylindrical current conductor, as described in, for example, Japanese Patent 3840934 (Patent Document 2). A plurality of slots are formed at an angle on the circumferential surfaces of the cylindrical current conductor and contact piece, forming a coil as a whole with at least one turn. When the vertical magnetic field electrodes 3 and 4 open and a current shutdown occurs, currents flow in the coils of these vertical magnetic field electrodes, generating a sufficiently large magnetic field.

When the common operating unit 10 of the large-capacity vacuum circuit breaker shown in FIG. 1 is operated, shutdown operations are concurrently performed. How the large-capacity vacuum circuit breaker operates at that time will be described next.

As is well known, unlike a gas circuit breaker and the like, a vacuum circuit breaker generates an arc voltage having positive characteristics between the electrodes when current is shut down. It is also known that when arc current increases, the arc voltage also increases. Accordingly, the positive characteristics enable the vacuum circuit breakers connected in parallel to shut down the current.

Figure 3:
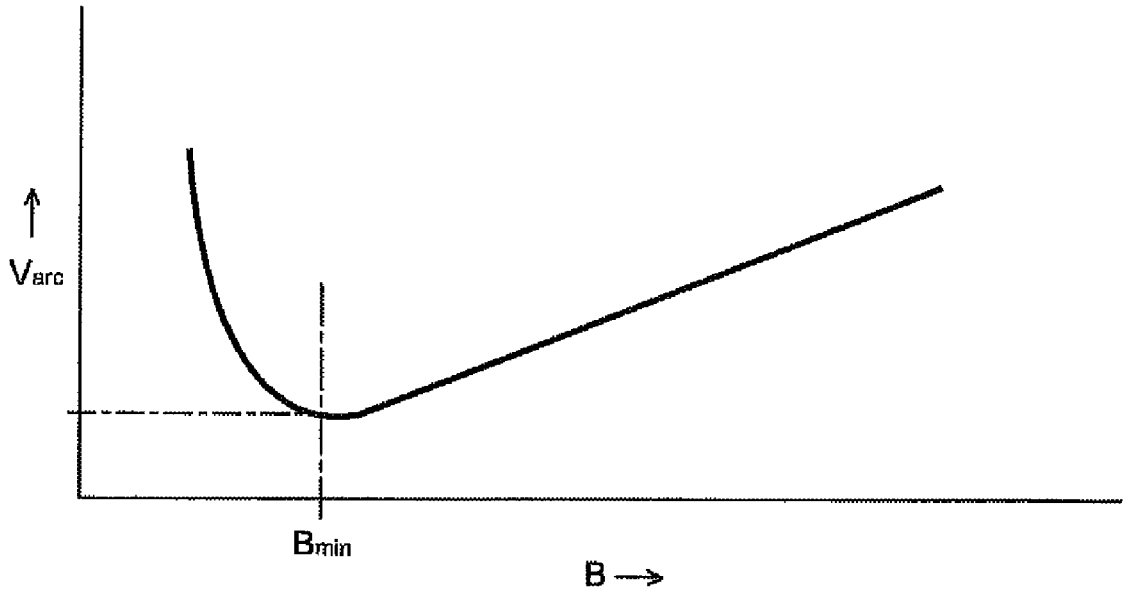
FIG. 3 illustrates the relation between vertical magnetic field intensity and arc voltage in a vacuum circuit breaker.

When a vertical magnetic field is applied to the arc voltage generated during current shutdown, if the intensity of the vertical magnetic field applied is changed with the applied current left unchanged, the vacuum circuit breaker shows characteristics, as shown in FIG. 3, in which an arc voltage Varc is minimized at a certain vertical magnetic field strength Bmin.

As described above, the vacuum circuit breaker units 1A and 1B of the large-capacity vacuum circuit breaker in the present invention have the same structure, in which the internal vertical magnetic field generating means is provided, and are connected in parallel, so voltages applied to these vacuum circuit breaker units are, of course, at the same level. Suppose that when the vacuum circuit breaker units 1A and 1B connected in parallel are concurrently operated by the common operating unit 10, as shown in FIG. 4 there is a difference in intensity between current Il flowing in the vacuum circuit breaker unit 1A and current Ih flowing in the vacuum circuit breaker unit 1B due to errors in electrode shapes, operation mechanisms, etc., where Il is smaller than Ih.

Figure 4:
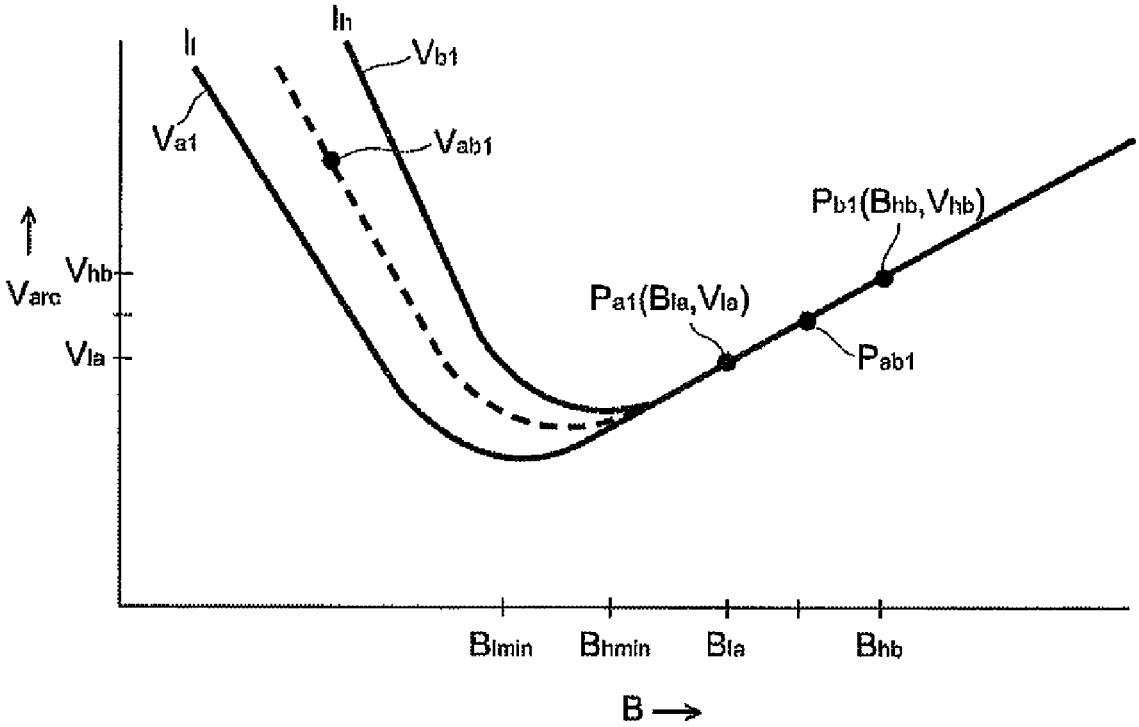
FIG. 4 is a characteristic graph illustrating an operation during shutdown by the large-capacity vacuum circuit breaker in the first embodiment shown in FIG. 1.

The vacuum circuit breaker units 1A and 1B, including the vertical magnetic field generating means and having a large vertical magnetic field intensity, have relations between the vertical magnetic field strength and the arc voltage, which are represented by characteristic curves Va1 and Vb1 of the currents Il and Ih, as shown in FIG. 4, the characteristic curve Va1 including the minimum vertical magnetic field intensity Blmin and the characteristic curve Vb1 including the minimum vertical magnetic field intensity Bhmin.

When the electrodes open in the vacuum circuit breaker units 1A and 1B and a shutdown occurs in which arcs are generated, the vertical magnetic field electrodes 3 and 4, which constitute the vertical magnetic field generating means, generate a vertical magnetic field and a sufficiently high vertical magnetic field intensity is applied. Therefore, shutdown points are point Pa1, at which the vertical magnetic field intensity is high (the vertical magnetic field intensity is Bla, and the arc voltage is Vla), which is positioned to the right of the vertical magnetic field intensity point Blmin in FIG. 4, and point Pb1, at which the vertical magnetic field intensity is high (the vertical magnetic field intensity is Bhb, and the arc voltage is Vhb), which is positioned to the right of the vertical magnetic field intensity point Bhmin.

In the initial state in which the vertical magnetic field electrodes 3 and 4 open and an arc is generated, the arc voltage Vla is lower than the arc voltage Vhb. Since, however, a vertical magnetic field is applied to the vacuum circuit breaker units 1A and 1B, which form a parallel circuit, the intensities of the currents flowing in the vacuum circuit breaker units 1A and 1B immediately change until the arc voltages Vla and Vhb become equal. More specifically, self-control is performed, in which the intensity of the current Il flowing in the vacuum circuit breaker unit 1A changes so that it is increased, and the intensity of the current Ih flowing in the vacuum circuit breaker unit 1B changes so that it is reduced. Finally, the shutdown points come close to the convergence point Pab1 (at which the vertical magnetic field intensities Bla and Bhb are equal, and the arc voltages Vla and Vhb are equal) on the characteristic curve V indicated by the dashed line in FIG. 4 at which the current intensities Il and Ih become equal, and settle.

Accordingly, since the vacuum circuit breaker units 1A and 1B are used at vertical magnetic field intensities of Bh and Bl, which are larger than the minimum vertical magnetic field intensities Bhmin and Blmin, at a shutdown time, currents Iha and Ila become equal due to self-control, enabling the vacuum circuit breaker units 1A and 1B to reliably carry out a concurrent shutdown.

Second Embodiment

Figure 2:
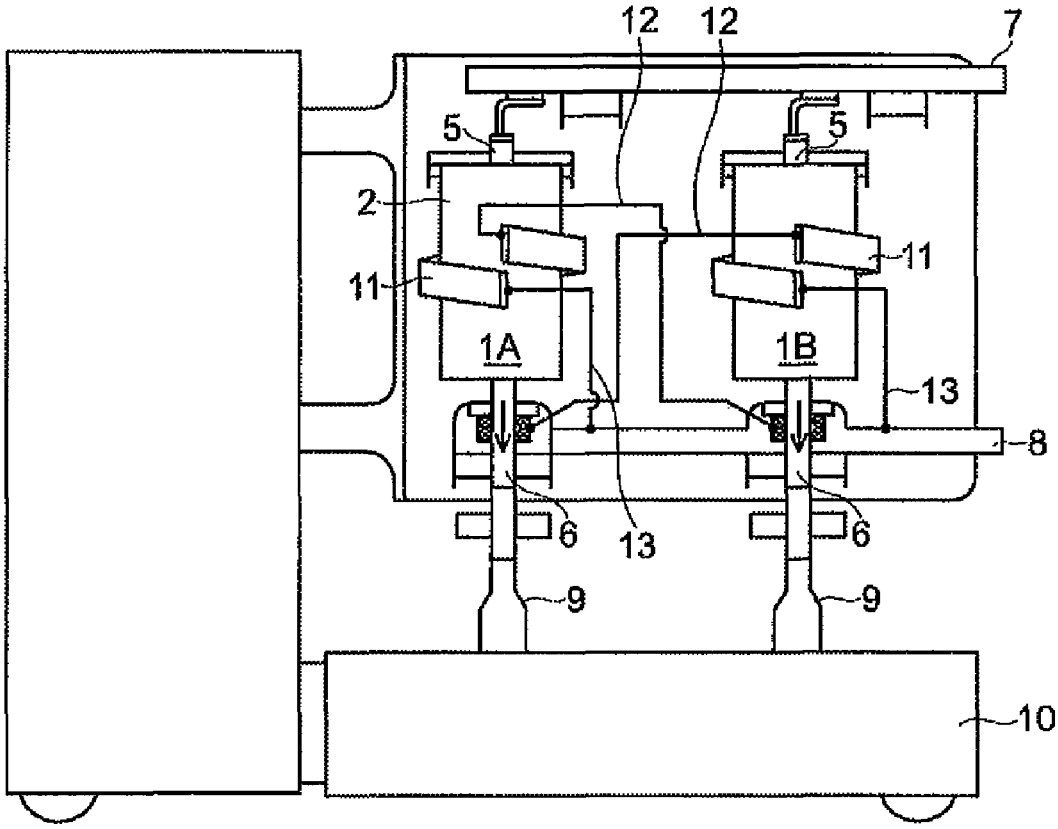
FIG. 2 is a schematic side view of a large-capacity vacuum circuit breaker in a second embodiment of the present invention.

In an exemplary large-capacity vacuum circuit breaker in a second embodiment, shown in FIG. 2, two vacuum circuit breaker units 1A and 1B connected in parallel use an electrode structure in which the vertical magnetic field is low or disc electrodes or other types of electrodes having no vertical magnetic field generating capability are employed. Specifically, the large-capacity vacuum circuit breaker is applied to a case in which since the vacuum circuit breaker units 1A and 1B are always used and the electrode structure cannot be changed due to restrictions on the internal dimensions and other factors, it is impossible that the magnetic flux density of a magnetic field generated around the electrodes becomes larger than Bmin. The vacuum circuit breaker units 1A and 1B each have an external vertical magnetic field generating means.

The vertical magnetic field generating means of the vacuum circuit breaker units 1A and 1B has an external coil 11 with at least one turn, which is made of a copper plate or the like, on the outer circumferences of the vacuum containers 2. The upper end of the external coil 11 of the vacuum circuit breaker unit 1A, from which the turn starts, is connected to the current conductor 6 of the vacuum circuit breaker unit 1B through a current collecting terminal or the like by using a connecting conductor 12, and the lower end of the turn, at which the turn is terminated, is connected to the lower terminal 8, which is common to the vacuum circuit breaker units 1A and 1B, by using a connecting conductor 13. The upper end and lower end of the external coil 11 of the vacuum circuit breaker unit 1B are similarly connected to the vacuum circuit breaker unit 1A and the lower terminal 8, respectively.

Although, in this embodiment, the external coils 11 disposed on the outer circumferences of the vacuum circuit breaker units 1A and 1B are oriented in the same direction, they may have different orientations by, for example, being turned so that the connections made by using the connecting conductors 12 and 13 are facilitated.

Since the external coils 11 are connected as described above, when current shutdown occurs, part of current flowing in the current conductor 6 of one of the vacuum circuit breaker units 1A and 1B branches into the external coil 11 disposed on the other vacuum circuit breaker unit and reaches the lower terminal 8. In this case, the currents flowing in the external coils 11 generate a sufficiently larger vertical magnetic field than the vertical magnetic field with intensity Bmin and the generated vertical magnetic field is added to the arcs of the vacuum circuit breaker units 1A and 1B, enabling an efficient current shutdown to be performed as described above.

The vacuum circuit breaker units 1A and 1B in this embodiment have weak vertical magnetic field intensities and the intensities of the currents Il and Ih differ. When Il is smaller than Ih, for example, how a shutdown occurs will be described by using the characteristic chart in FIG. 5.

Figure 5:
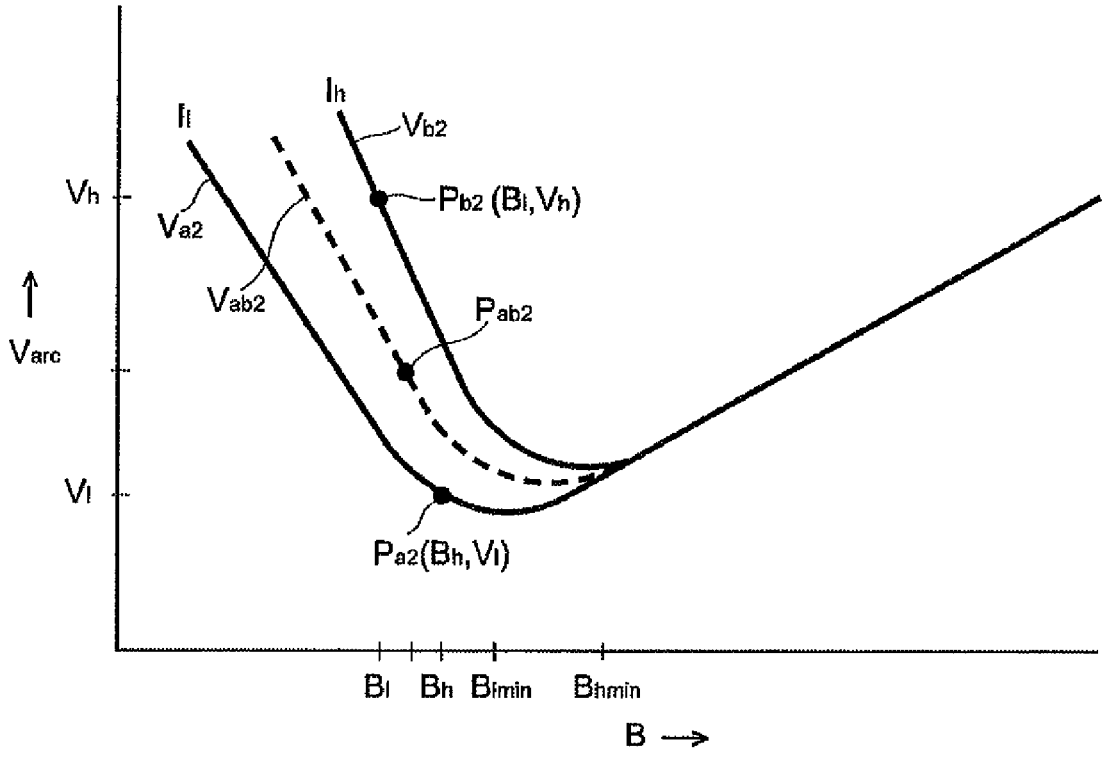
FIG. 5 is a characteristic graph illustrating an operation during shutdown by the large-capacity vacuum circuit breaker in the second embodiment shown in FIG. 2.

The characteristics of currents Il and Ih (Il<Ih) flowing in the vacuum circuit breaker units 1A and 1B are represented by the characteristic curves Va2 and Vb2, as shown in FIG. 5, which respectively include the minimum vertical magnetic field intensities Blmin and Bhmin. If the currents Il and Ih flowing in the vacuum circuit breaker units 1A and 1B having weak vertical magnetic field intensities have different intensities at the initial stage of a shutdown, there are two shutdown points as described below.

The shutdown point of the vacuum circuit breaker unit 1A, in which the low current Il flows during the shutdown, is Pa2 positioned to the left of the vertical magnetic field Blmin on the characteristic curve Va2, at which the vertical magnetic field intensity is Bh. The shutdown point of the vacuum circuit breaker unit 1B, in which the high current Ih flows during the shutdown, is Pb2 positioned to the left of the vertical magnetic field Bhmin on the characteristic curve Vb2, at which the vertical magnetic field intensity is Bl.

However, the vacuum circuit breaker units 1A and 1B have the external coils 11, which are interconnected through the connection conductors 12, so that current flows into the external coil 11 of each vacuum circuit breaker unit from the current conductor 6 on the distant vacuum circuit breaker unit, as described above. Therefore, currents with different intensities flow into the external coils 11 when an arc is generated. Specifically, since high current branches from the current conductor 6 on the vacuum circuit breaker unit 1B into the external coil 11 of the vacuum circuit breaker unit 1A, and since low current branches into the external coil 11 of the vacuum circuit breaker unit 1B, vertical magnetic fields with sufficiently larger intensities than the above vertical magnetic field intensity Bmin are generated in the external coils 11 due to currents with different intensities, and the generated vertical magnetic fields are added to the arcs.

As a result, in the vacuum circuit breaker units 1A and 1B in the state in which the high vertical magnetic fields are applied to the arcs, the shutdown point Pa2 (at which the vertical magnetic field intensity is Bh, and the arc voltage is Vl) on the characteristic curve Va and the shutdown point Pb2 (at which the vertical magnetic field intensity is Bl, and the arc voltage is Vh) on the characteristic curve Vb move toward a point Pab2 on the characteristic curve Vab2 indicated by the dashed line in FIG. 5 at which current intensities Il and Ih become equal.

More specifically, the vacuum circuit breaker unit 1A, in which the low shutdown current Il flows, is affected by the vertical magnetic field generated when the current Ih from the distant vacuum circuit breaker flows into the external coil 11, and thereby the characteristic curve Va2 moves right, in which case the current Il at the shutdown point Pa2 increases and the arc voltage Vl is raised. The vacuum circuit breaker unit 1B, in which the high current Ih flows, is affected by the vertical magnetic field generated when the current Il from the distant vacuum circuit breaker flows into the external coil 11, and thereby the characteristic curve Vb2 moves left, in which case the current Ih at the shutdown point Pb2 decreases and the arc voltage Vh is lowered. As a result, the shutdown points of both the vacuum circuit breaker units 1A and 1B move to point Pab2 on the characteristic curve Vab and settle at that point. Since the shutdown points converge to Pab2 at which the arc voltages Vl and Vh become equal (the shutdown currents Il and Ih become equal, the vertical magnetic field intensities Bl and Bh become equal, and the arc voltages Vh and Vl become equal) in this way, both the vacuum circuit breaker units 1A and 1B can reliably perform shutdown operations at the same time.

Accordingly, if vertical magnetic field generating means are provided on the outer circumferences of the vacuum circuit breaker units 1A and 1B, as in this embodiment, the same effect as in the example described above can be obtained although the spacing between these vacuum circuit breaker units placed side by side becomes large a little. Furthermore, even if vacuum circuit breaker units having a conventional structure are used, a large-capacity vacuum circuit breaker can be easily structured and thereby easily manufactured.

The above embodiments have been described for a large-capacity vacuum circuit breaker for a single phase, which is structured by means of two vacuum circuit breaker units, each having a vertical magnetic field generating means, which are placed side by side and connected in parallel. A large-capacity vacuum circuit breaker for three phases can be structured by placing vacuum circuit breaker units in succession for the U, V, and W phases.

The large-capacity vacuum circuit breaker in the present invention can also be structured by connecting three vacuum circuit breaker units in parallel for a single phase. In this arrangement as well, even if different currents flow in the vacuum circuit breaker units at the initial time, a stable state is obtained at a point where the currents substantially become equal, enabling the current to be shut down in the same way as in the above embodiments.

INDUSTRIAL APPLICABILITY

The large-capacity vacuum circuit breaker of the present invention can be used in an electric power transformation facility or power distribution facility, and is very effective in making the facility compact.

The invention claimed is:

1. A large-capacity vacuum circuit breaker comprising:

a first vacuum circuit breaker unit and a second vacuum circuit breaker unit, said vacuum circuit breaker units having the same capacity and being placed side by side and electrically connected in parallel; and a single common operating unit which operates said first and second vacuum circuit breaker units so as to perform a circuit shut down operation; and wherein said first and second vacuum circuit breaker units have first and second vertical magnetic field generating means for each generating a vertical magnetic field, said vertical magnetic field being added to an arc generated during current shut down, and wherein said first and second vertical magnetic field generating means comprise a first external coil on an external surface of a vacuum container of said first vacuum circuit breaker unit and a second external coil on an external surface of a vacuum container of said second vacuum circuit breaker unit, respectively, one end of said first external coil being connected to a second current conductor on the side of said second vacuum circuit breaker unit through a second current collector on the side of said second vacuum circuit breaker unit and the other end of said first external coil being connected to a lower terminal, and one end of said second external coil being connected to a first current conductor on the side of said first vacuum circuit breaker unit through a fist current collector on the side of said fist vacuum circuit breaker unit and the other end of said second external coil being connected to said lower terminal, whereby the currents flowing through said first and second vacuum circuit breaker units during current shut down are equal to each other.

* * * * *